US010890320B1

(12) United States Patent
Seneca

(10) Patent No.: US 10,890,320 B1
(45) Date of Patent: Jan. 12, 2021

(54) CUSTOMIZABLE AND PORTABLE FUEL TORCH DISPLAY ASSEMBLY

(71) Applicant: Kiki Torches, Inc., Tamarac, FL (US)

(72) Inventor: Gina Seneca, Lauderhill, FL (US)

(73) Assignee: Kiki Torches Inc, Lauderhill, FL (US)

( * ) Notice: Subject to any disclaimer, the term of this patent is extended or adjusted under 35 U.S.C. 154(b) by 0 days.

(21) Appl. No.: 16/305,526

(22) PCT Filed: Jun. 22, 2018

(86) PCT No.: PCT/US2018/039169
§ 371 (c)(1),
(2) Date: Nov. 29, 2018

(87) PCT Pub. No.: WO2018/237363
PCT Pub. Date: Dec. 27, 2018

Related U.S. Application Data

(60) Provisional application No. 62/523,590, filed on Jun. 22, 2017.

(51) Int. Cl.
*F21V 37/00* (2006.01)
*F21V 3/00* (2015.01)
*F21W 121/00* (2006.01)

(52) U.S. Cl.
CPC ..... *F21V 37/0008* (2013.01); *F21V 3/00* (2013.01); *F21V 37/00* (2013.01); *F21W 2121/00* (2013.01)

(58) Field of Classification Search
CPC ..... F21V 37/00; F21V 37/00089; F21V 37/0016; F21W 2121/00; F21W 2121/002; F21W 2121/004; F21W 2121/006; F21W 2121/008; F21W 2121/02; F21W 2121/04; F21W 2121/06
See application file for complete search history.

(56) References Cited

U.S. PATENT DOCUMENTS

| | | | |
|---|---|---|---|
| 2,525,432 | A | 10/1950 | Stadler |
| 5,057,003 | A | 10/1991 | Yang |
| 5,205,730 | A | 4/1993 | Capdeville |
| 5,547,371 | A | 8/1996 | Rose |
| 5,807,093 | A | 9/1998 | Tendick |
| 5,902,101 | A | 5/1999 | Palmer et al. |
| 6,716,026 | B1 | 4/2004 | Beougher |
| 7,097,448 | B2 | 8/2006 | Chesney |

(Continued)

*Primary Examiner* — Robert J May
(74) *Attorney, Agent, or Firm* — Mark C. Johnson; Johnson Dalal

(57) ABSTRACT

A fuel torch display assembly including a base member, an inner canister member coupled to the base member and with a can channel having the fuel canister disposed therein. The assembly includes an outer canister member of a transparent material defined on a portion thereon and an inner surface with a radial retention flange having an upper wall and a sidewall defining an inner canister member retention zone with an enclosed sidewall of the inner canister member disposed therein and the outer surface of the enclosed sidewall of the inner canister member and the inner surface of the enclosed sidewall of the outer canister member defining and flanking an indicia medium placement zone with an indicia medium selectively removably disposed therein adjacent to the transparent material to display an indicia disposed on the indicia medium to an outside ambient environment of the fuel torch assembly.

18 Claims, 6 Drawing Sheets

(56) References Cited

U.S. PATENT DOCUMENTS

| | | | | |
|---|---|---|---|---|
| 7,156,653 | B1 | 1/2007 | DeMars | |
| 7,670,136 | B2 * | 3/2010 | Bishop | F23D 14/28 431/125 |
| D676,160 | S | 2/2013 | Stephens | |
| 2006/0147864 | A1 | 7/2006 | Donley | |
| 2006/0251997 | A1 | 11/2006 | Schulte et al. | |
| 2015/0049470 | A1 | 2/2015 | Kimmel | |
| 2016/0281945 | A1 | 9/2016 | White | |

* cited by examiner

100

CUSTOMIZABLE AND PORTABLE FUEL TORCH DISPLAY ASSEMBLY

CROSS-REFERENCE TO RELATED APPLICATION

This application is a national stage filing of International Application Number PCT/US18/39169, filed Jun. 22, 2018, which claims priority to U.S. Provisional Patent Application No. 62/523,590 filed Jun. 22, 2017, the entirety of which is incorporated by reference.

FIELD OF THE INVENTION

The present invention relates generally to portable ignitable devices, and, more particularly, relates to portable fuel torches operable to be free-standing with respect to a support surface such as the ground.

BACKGROUND OF THE INVENTION

Portable torches, fuel burning assemblies, or other ignitable devices (for brevity referred to herein as "fuel torches") are employed by many users for lighting an ambient environment area and/or providing an aesthetically pleasing or theme-fitting appearance. Most of these fuel torches consist of an outer shell encapsulating a flammable or combustible fuel, such as petroleum, conventionally housed in a fuel cell. The fuel torches also often include a flammable medium such as a wick to generate the flame, heat, and/or light from the top end of the fuel torch. There are various different fuels employed to facilitate in lighting the fuel torch, most of which are made up of hydrocarbons, which contain a lot of energy. The fuel may also be derived from a chemical group called naphthas. These are liquids that fall somewhere in the distillation process between light gases and heavier liquids like kerosene.

Some known fuel torches also include an umbrella top removably coupled to the top of the outer shell of the canister to deflect rain, waters, or other environmental elements away from the inside of the outer shell where the fuel is housed. Additionally, these fuel torches also typically include a removably couplable cap (commonly referred to as a "snuffer") that facilitates in removing the flame from the fuel torch by inhibiting the introduction of oxygen. Of all the aforementioned components, however, do not provide users the ability to effectively or efficiently display one or more image(s), text(s), or other indicia to those users in the ambient environment, further enhancing and/or customizing the user and/or aesthetic experience. Those known fuel torches also do not enable uses to provide this customizable fuel torch display in a versatile manner that will facilitate in keeping any indicia dry and inhibit degradation.

For example, a couple known examples of fuel torch assemblies operable to display indicia include those disclosed in Tendick Sr., U.S. Pat. No. 5,807,093 ("Tendick") and Kimmel et al., U.S. Patent Application Publication No. 2015/0049470 ("Kimmel"). Tendick relates to a "flameguard" removably couplable to a fuel support member. This flameguard includes permanently etched or molded designs disposed on the outer surface of the flameguard. Inconveniently, when a user wants to convey or display a particular image, he or she is required to replace the entire flameguard, which is costly and may not be feasible if the manufacturer does not make the desired design of the user. Similarly, Kimmel relates to a "burner cup" that also includes a sleeve with indicia on it. however, it too suffers from the same disadvantages of Tendick.

Therefore, a need exists to overcome the problems with the prior art as discussed above.

SUMMARY OF THE INVENTION

The invention provides a customizable and portable fuel torch display assembly that overcomes the hereinaforementioned disadvantages of the heretofore-known devices and methods of this general type and that enables effective and efficient display of indicia through a fuel torch assembly. As such, with the foregoing and other objects in view, there is provided, in accordance with the invention, a fuel torch display assembly including a base, inner and outer canister members, and an umbrella cover. More specifically, the base member has a bottom wall with an inside surface and a sidewall surrounding the bottom wall, wherein the inside surface of the base member supports a fuel canister with a distal end that may project from the canister members for access by a user, e.g., lighting by a user. The inner canister member has an enclosed sidewall having a lower end coupled to the base member, an upper end, an inner surface, an outer surface opposing the inner surface, a can channel defined by the inner surface of the enclosed sidewall of the inner canister member, and a distal opening defined by the upper end of inner canister member, wherein the can channel with the fuel canister disposed therein. The outer canister member has an enclosed sidewall having an inner surface and of a transparent material defined on a portion thereon, a lower end, an upper end defining an upper opening and opposite the lower end of the enclosed sidewall, and an inner surface with a radial retention flange. The radial retention flange may include an upper wall extending from a first end radially inward from the inner surface of the outer canister member toward the can channel and terminating at a second end opposite the first end and a sidewall with a first end extending in a longitudinal direction from the second end of the upper wall of the radial retention flange toward the bottom wall of the base member and terminating at a second end opposite the first end of the sidewall of the radial retention flange. The upper wall and sidewall of the radial retention flange defines an inner canister member retention zone with the enclosed sidewall of the inner canister member disposed therein and the outer surface of the enclosed sidewall of the inner canister member and the inner surface of the enclosed sidewall of the outer canister member defining and flanking an indicia medium placement zone with an indicia medium selectively removably disposed therein and adjacent to the portion of the enclosed sidewall of the transparent material, thereby displaying an indicia disposed on the indicia medium to an outside ambient environment of the fuel torch assembly. The umbrella cover removably coupled to the outer canister member and enclosing and defining an exit aperture with the distal end of the fuel canister disposed therein. A cap may be removably coupled to the umbrella cover and superimposing the exit aperture for securely covering the wick/fuel canister.

In accordance with a further feature of the present invention, the enclosed sidewall of the inner canister member, wherein the enclosed sidewall of the outer canister member, and the indicia medium placement zone are cylindrical.

In accordance with an additional feature, the indicia medium is of a printable paper material.

In accordance with another feature, an embodiment of the present invention includes the radial retention flange having an upper wall length separating the first and second ends of the upper wall of the radial retention flange and a second sidewall with a first end extending in a longitudinal direction from a location along the upper wall length toward the bottom wall of the inside surface of the base member and terminating at a second end opposite the first end of the second sidewall of the radial retention flange, wherein the upper wall, the sidewall, and the second sidewall of the radial retention flange defining the inner canister member retention zone.

In accordance with yet another feature of the present invention, the upper wall, sidewall, and second sidewall of the radial retention flange continually span an inside perimeter of the inner surface of the outer canister member.

In accordance with a further feature of the present invention, the sidewall and second sidewall of the radial retention flange are disposed in a substantially parallel orientation with respect to one another.

In accordance with another feature, an embodiment of the present invention also includes an inner canister thickness defined by inner and outer surfaces of the inner canister member and a canister retention length separating inner surfaces of the sidewall and second sidewall of the radial retention flange, wherein the canister retention length of approximately the same magnitude as the inner canister thickness.

In accordance with an additional of the present invention, the upper wall and sidewall of the radial retention flange continually span an inside perimeter of the inner surface of the outer canister member.

In accordance with yet another feature, an embodiment of the present invention also includes upper and lower threaded configurations coupled and disposed proximal to the upper and lower ends, respectively, of the outer canister member, the upper threaded configuration interposed between the radial retention flange and the upper end of the outer canister member, a threaded configuration coupled and disposed proximal to an upper end of the base member and operably configured to engage in a locking configuration with the lower threaded configuration of the outer canister member, and a threaded configuration coupled and disposed proximal to a lower end of the umbrella cover and operably configured to engage in a locking configuration with the upper threaded configuration of the outer canister member.

In accordance with yet another feature, an embodiment of the present invention also includes a stabilization member coupled to and disposed on the inside surface of the base and an inner canister stabilization member coupled to and disposed on a lower end of the inner canister member, the stabilization member of the base and the inner canister stabilization member of the inner canister member selectively removably coupled together in a male-female configuration restricting lateral movement of the inner canister member.

In accordance with yet another feature, an embodiment of the present invention also includes the base having a bottom wall coupled to the enclosed sidewall of the inner canister member and having an inner surface and an outer surface, opposing the inner surface of the bottom wall of the inner canister, with the inner canister stabilization member coupled thereto and a fuel canister displacement member coupled to and extending upwardly away from the inner surface of the bottom wall and terminating at a distal end directly coupled to and supporting the fuel canister.

In accordance with an additional of the present invention, the upper wall, sidewall, and second sidewall of the radial retention flange continually span an inside perimeter of the inner surface of the outer canister member.

Although the invention is illustrated and described herein as embodied in a customizable and portable fuel torch, commonly referred to as a "tiki torch" that overcomes various disadvantages of the known devices and methods. Although the invention is illustrated and described herein as embodied in a customizable and portable fuel torch, it is, nevertheless, not intended to be limited to the details shown because various modifications and structural changes may be made therein without departing from the spirit of the invention. Additionally, well-known elements of exemplary embodiments of the invention will not be described in detail or will be omitted so as not to obscure the relevant details of the invention. The present invention provides users the ability to effectively and safely customize a fuel torch with text, pictures, or other indicia. As discussed herein, the indicia can be customized by the user to provide a personal touch to family events, restaurants, and other outings and locations.

It is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. It is believed that the invention will be better understood from a consideration of the following description in conjunction with the drawing figures, in which like reference numerals are carried forward. The figures of the drawings are not drawn to scale, but include exemplary dimensions a person of skill in the art may use to carry out the present invention.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the cover, spanning in the direction from the bottom end to the top end.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
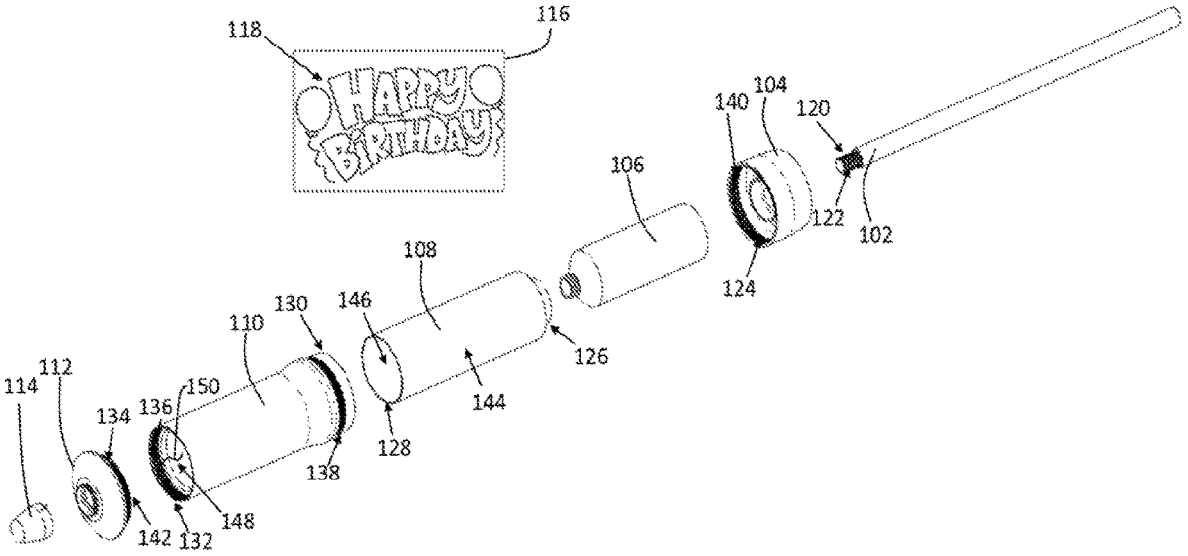
FIG. 1 is an exploded view of a customizable and portable fuel torch display assembly in accordance with one embodiment of the present invention.
Figure 2:
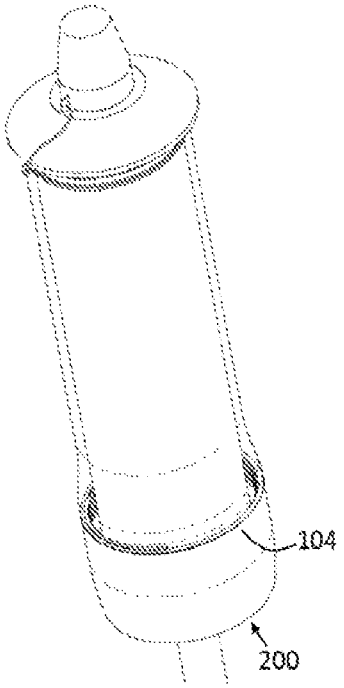
FIG. 2 is a fragmentary perspective view of the fuel torch display assembly of FIG. 1 assembled and without an indicia medium inserted therein.
Figure 3:
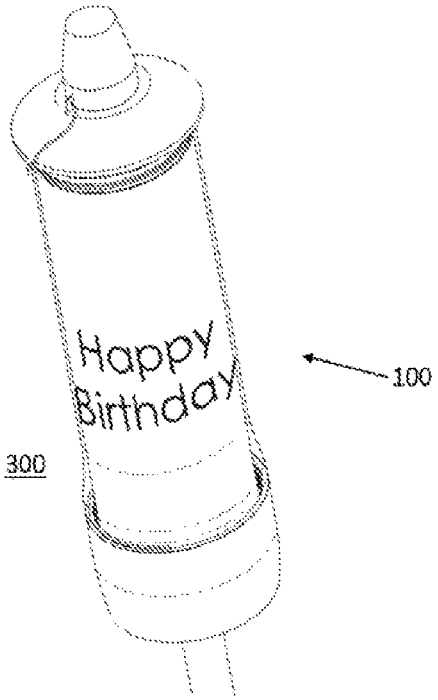
FIG. 3 is a fragmentary perspective view of the fuel torch display assembly of FIG. 1 assembled and with an indicia medium inserted therein.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient portable and customizable fuel torch display assembly that enables users to easily, effectively, and safely display desired and customizable indicia to a viewing public. Embodiments of the invention also provide users the ability to utilize the torch assembly in connection with a pole assembly for vertically displaced projection or in connection with a flat surface, e.g., a tabletop, for elevational projection or display.

Referring now to FIG. 1, one embodiment of the present invention is shown in an exploded view. FIG. 1 shows several advantageous features of the present invention, but, as will be described below, the invention can be provided in several shapes, sizes, combinations of features and components, and varying numbers and functions of the components. The first example of a fuel torch display assembly 100, as shown in FIG. 1, may include a pole member 102 selectively removable to a base 104. The base 104 facilitates in supporting a fuel can 106. The assembly 100 also includes an inner canister member 108 (also referred to as an "inner shell") removably couplable to the base 104.

An indicia medium 116, e.g., paper, with an indicia 118 printed thereon, e.g., Happy Birthday with balloons, is also depicted. As will be described in more detail below, the indicia medium 116 is surrounding all or a portion of the inner canister member 108. The assembly 110 also includes an outer canister member 110 (also referred to as an "outer shell") that surrounds the inner canister member 108 and the indicia medium 116. The outer canister member 110 is of a transparent material that enables the indicia 118 to be effectively displayed to the ambient outside environment of the assembly 100. The assembly 100 may also include an umbrella cover 112 and a cap 114, e.g., snuffer, to seal and/or protect a wick of the fuel can 106 employed with the assembly 100.

Referring now to FIGS. 1-4, the base member 104 may have a bottom wall 400 with an inside surface 402 and a sidewall 404 surrounding the bottom wall 400. In one embodiment, the inside surface 402 of the base member 104 supports the fuel canister 106 through the inner canister member 108. In other embodiments, the base member 104 may directly support and be directly coupled to the fuel canister 106 or the umbrella member 112 may directly support the fuel canister 106. In further embodiments, a bottom wall 412 of the inner canister 108 may include a fuel canister displacement member 414 attached at one end to the inner surface 410 of the bottom wall 412, extending upwardly away from, in the longitudinal direction, the inner surface 410, and terminating at a distal end 416 directly coupled to and supporting the fuel canister 106. In preferred embodiments, the length of can displacement from the inner surface 410 is approximately 2-4 inches, while in other embodiments, the length may vary. As such, the can channel 418 defined by the inner canister member 108 is kept at a relatively lower temperature to protect the indicia medium from degradation or damage.

In one embodiment, the base 104, enclosed outer canister member 110, and inner canister member 108 may be formed as separate independent pieces as shown best in FIG. 1. Alternatively, however, said components may be formed into unitary pieces that separate or open in different configurations, yet enable insertion and removal of the indicia medium 116 as described herein. The base 104, along with the canister members 108, 110, umbrella 112, cap 114, etc., may be of substantially rigid material, e.g., PVC, PTFE, or another polymeric, metallic or ceramic material, having a hardness range of approximately 45-65 Shore D durometer. Said components may also preferably be waterproof to resist degradation in outside environmental conditions such as rain.

The base 104 may form an aperture/recess with a threading configuration thereon that is operably configured to engage in a locking relationship (i.e., resist longitudinal movement) with a threaded configuration 120 of the pole member 102. This embodiment is preferable should a user desire to utilize the fuel assembly 100 in a vertically displaced configuration by inserting a proximal end 122 of the pole member 102 into a ground surface. Alternatively, the distal end 122 of the pole member 102 may form a recess shaped and configured to receive/retain a male member of the base 104. Additionally, other retaining configurations also contemplated, e.g., tongue-and-groove, adhesive, etc.

The pole member 102 may be a single unitary piece of a substantially rigid material or may also consist of modular pole segments that are operably configured to couple with one another and the base member 104 using, for example, the threaded configurations to form a desired height of the torch assembly 100. Each of the pole segments may have respective ends with the same threaded configuration so any one of the pole segments may couple with either the base member 104 or other post segment(s). As seen in the figures, the assembly 100 is also beneficially configured to have the pole member 102 removed from the base member 104, wherein the torch assembly 100 can be supported on a surface without the use of the pole member 102, e.g., a tabletop. Said another way, a bottom surface 300 of the base 104, which defines the pole recess, is substantially planar to provide a safe and upright orientation of the fuel can 106 supported thereon.

Still referring to FIGS. 1-4, in one embodiment the base 104, canister members 108, 110, umbrella 112, and cap 114 are selectively removably couplable together using complementary threaded configurations operably configured to engage and retain opposing components in the longitudinal direction. Specifically, the upper end 132 and lower end 130 of the outer canister member 110 may include respective upper and lower threaded configurations 136, 138 coupled and disposed proximal thereto (i.e., at or near). The base member 104 also includes a threaded configuration 140 coupled and disposed proximal to an upper end 124 thereof. The threaded configuration 140 of the base member 104 is operably configured to engage in a locking configuration with the lower threaded configuration 138 of the outer canister member 110. Additionally, the threaded configuration 142 of the umbrella cover 112 is coupled and disposed proximal to the lower end 134 thereof. Similarly, the threaded configuration 142 is operably configured to engage in a locking configuration with the complementary upper threaded configuration 136 of the outer canister 110 disposed at the upper end 132 thereof. While the threaded configuration facilitates in advantageously providing users a quick, easy, and substantially watertight connection, in other embodiments, the components may selectively removably couple together using, for example, tongue-and-groove configurations, among others.

Figure 4:
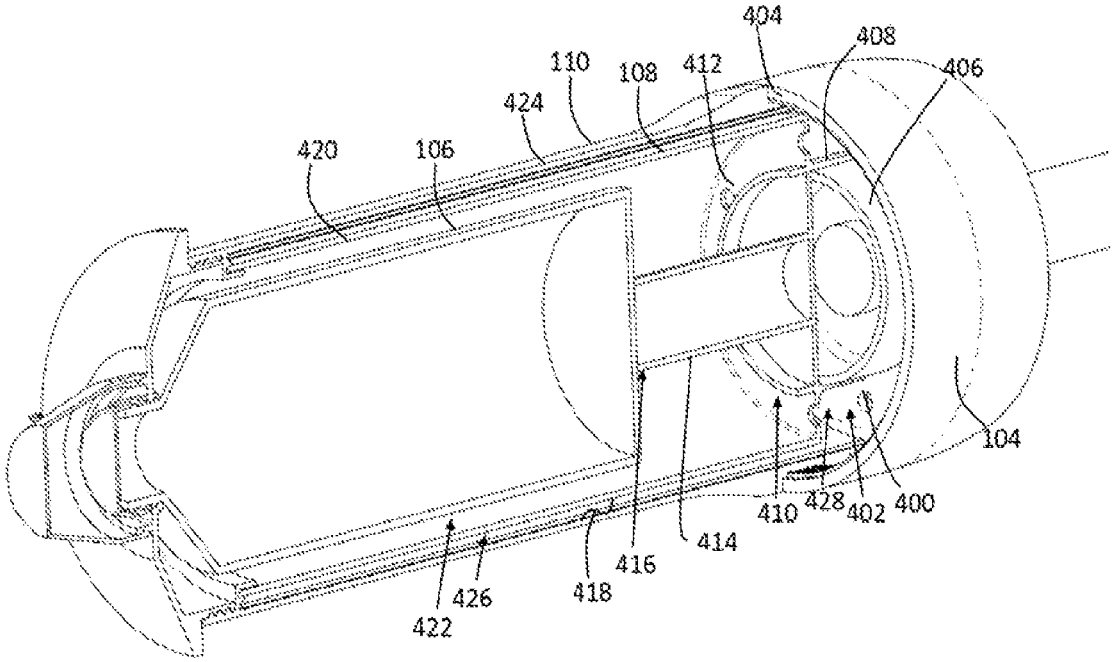
FIG. 4 is a fragmentary perspective partially cross-sectional view of the fuel torch display assembly of FIG. 1.
Figure 5:
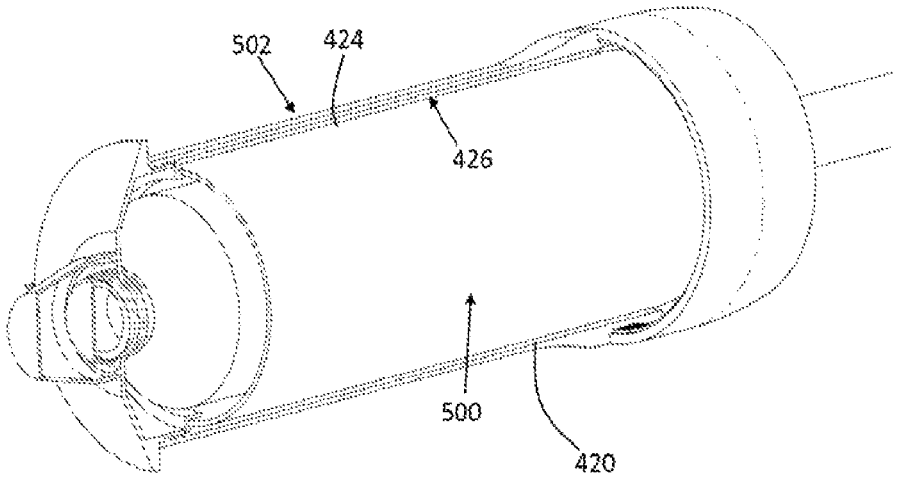
FIG. 5 is another fragmentary perspective partially cross-sectional view of the fuel torch display assembly of FIG. 1.

With reference to FIGS. 1 and 4, the base 104 may include a stabilization member 406 coupled to and disposed on the inside surface 402 of the base 104. Correspondingly, the inner canister member 108 may include a stabilization member 408 coupled to and disposed on a lower end 126 thereof. In one embodiment, the stabilization members 406, 408 are shaped and sized to friction fit with one another to orient the inner canister member 108 and/or fuel can 106 in an upright orientation with respect the inner surface 402 of the base 104. Said another way, the stabilization members 406, 408 may also be of a complementary male-female coupling configuration. The stabilization member 406 of the base 104 and the inner canister stabilization member 408 of the inner canister member 106 may be selectively removably coupled together to restrict lateral (or side-to-side) movement of the inner canister member 106. Said differently, the stabilization member 408 is disposed on an outer surface of the bottom wall 412 and includes sidewalls shaped to frictionally engage with the sidewalls of the stabilization member 406 of the base 104.

The inner canister member 108 includes an enclosed sidewall 420 with an inner surface 422, opposing an outer surface 144. The inner canister member also defines a distal opening defined by the upper end 128 thereof. The can channel 418 is sized to receive, house, and/or surround the fuel canister 106. The outer canister member 110 also includes an enclosed sidewall 424 having an inner surface 426, wherein the outer canister member 110 is either completely or partially of a transparent material to effectuate display of the indicia to the viewing public. The outer canister member 110 may also define an upper opening 148 at the upper end 132, opposite the lower end 130. The upper opening 148 is also shaped and sized to permit entry and egress of the fuel can 106 into a channel 150 defined therein.

With specific reference to FIGS. 1 and 4-6, the inner surface 426 of the outer canister 110 beneficially includes a radial retention flange 600 used to facilitate in retaining the inner canister member 108 and the indicia medium 116 when the members 108, 110 and base 104 are coupled together. Specifically, the radial retention flange 600 includes an upper wall 602 extending from a first end 604 radially inward from the inner surface 426 of the outer canister member 110 toward the can channel 418 and terminating at a second end 606 opposite the first end 604. The upper wall 602 or ceiling prevents movement of the inner canister member 108 in the longitudinal direction when the canisters 108, 110 are coupled together. The flange 600 also includes a sidewall 608 with a first end (also represented in FIG. 6 with arrow 606) extending in a longitudinal direction from the second end 606 of the upper wall 602 toward the bottom wall 400 of the base member 104 or bottom wall 412 of the inner canister member 108 and terminating at a second end 610 opposite the first end 606 of the sidewall 608. The sidewall 608 of the flange 600 prevents lateral movement of the inner canister member 108, facilitating in maintaining the desired orientation of the indicia medium 116. The upper wall 602 and sidewall 608 of the radial retention flange 600 defines an inner canister member retention zone 612 with the enclosed sidewall 420 of the inner canister member 108 disposed therein.

When the canisters 108, 110 are coupled together, the outer surface 500 of the enclosed sidewall 420 of the inner canister member 108 and the inner surface 426 of the enclosed sidewall 424 of the outer canister member 110 defining and flanking an indicia medium placement zone 502. The indicia medium placement zone 502 and sidewalls 420, 424 may be cylindrical to facilitate in effectively retaining the indicia medium 116. The indicia medium placement zone 502 may extend from the lower end 126 to the upper end 128 of the inner canister member 108. As such, a user may place the indicia medium 116 within the indicia medium placement zone 502 by either rolling the indicia medium 116 or otherwise creating a cylindrical shape that may be inserted upwardly into the channel 150 of outer canister member 110 through a lower opening 428 defined by a lower end 130 of the outer canister member 110. While the cylindrical shape provides an effective means to insert and remove the indicia medium 116 into the canister 110, other shapes are contemplated. Said another way, the indicia medium 116 may be selectively removably disposed within the indicia medium placement zone 502 and is adjacent to the portion of the enclosed sidewall 424 that is of the transparent material, which may be the entire sidewall 424. As such, the indicia 118 inscribed or printed on the indicia medium 116 is effectively and safely displayed to an outside ambient environment 300 (best seen in FIG. 3) of the fuel torch assembly 100. As seen best in FIG. 6, the upper threaded configuration 136 of the outer canister member 110 may be interposed between the radial retention flange 600 and the upper end 132 of the outer canister member 110.

Figure 6:
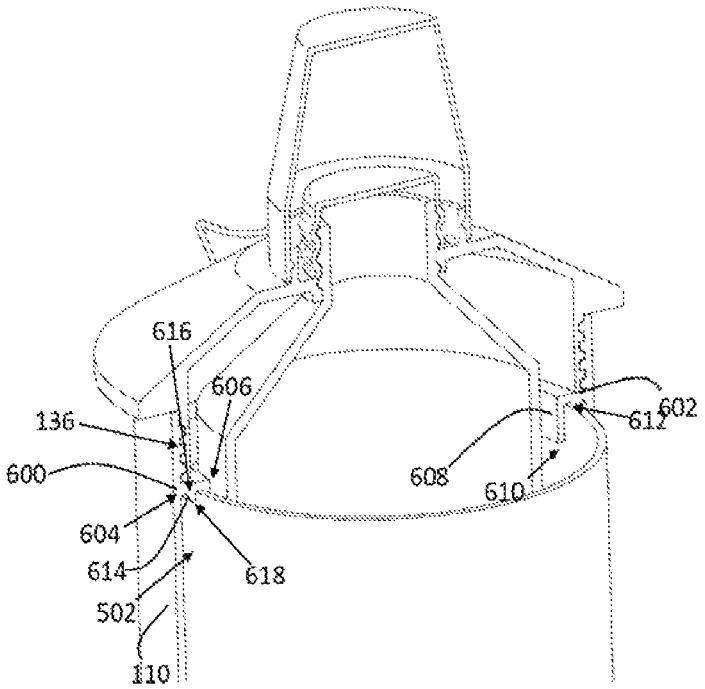
FIG. 6 is a close-up fragmentary perspective partially cross-sectional view of the fuel torch display assembly of FIG. 1.

Looking specifically at FIG. 6, the upper wall 602 may include a length separating the first and second ends 604, 606, wherein said length may range from 0.005-0.25 inches. Other ranges are contemplated based on the design applications and/or constraints. Beneficially, a second sidewall 614 with a first end 616 extending in a longitudinal direction from a location along the upper wall length toward the bottom wall 400 of the base member 104 and terminating at a second end 618 opposite the first end 618. In one embodiment, the second end 618 extends approximately 0.005-0.5 inches in length. In other embodiments, the second end 618 may extend approximately 1-8 inches in length or the length of the outer canister member 110 separating opposing ends 130, 132. In this second embodiment, the inner canister member 108 may be omitted from the design and the indicia medium 116 may inserted in the indicia placement zone defined by the sidewalls 608, 614 and the enclosed sidewall 424 of the outer canister member 110. In the formerdescribed embodiment, the upper wall 602, the sidewall 608, and the second sidewall 614 define the inner canister member retention zone 612. The upper wall 602, sidewall 608, and second sidewall 614 may also continually span an inside perimeter of the inner surface 426 of the outer canister member 110. In other embodiments, the upper wall 602, sidewall 608, and second sidewall 614 may intermittently span around the perimeter. To effectively retain the indicia medium 116 the sidewall 608 and second sidewall 614 are disposed in a substantially parallel orientation with respect to one another.

Additionally, the inner canister 108 may have an inner canister thickness, e.g., 0.05-0.5 inches, defined by inner and outer surfaces 422, 500 of the inner canister member 108, wherein the canister retention length separating inner surfaces of the sidewall 608 and second sidewall 614 of the radial retention flange 600 is approximately the same magnitude as the inner canister thickness. As such, a friction fitting relationship/configuration is formed. In one embodiment, the inner surfaces of the sidewall 608 and second sidewall 614 may have rubber gasket or sealing material to provide a tighter configuration with one another. Similarly, the coupling connection between the umbrella 112, cap 114, canister members 108, 110, and the base 104 may also include a rubber gasket or sealing material to facilitate in making the indicia placement zone 502 watertight or water resistant. The second sidewall 614, top wall 602, and sidewall 424 define an area where indicia medium 116 is placed or inserted within, thereby effectively retaining and convey a customizable and desired image, text, or other indicia to outside ambient environment 300 of the assembly 100.

For example, a user may then place a customizable writing indicia, e.g., "happy anniversary," "happy birthday," "Gina's house party," within the indicia placement zone 502 so it can be viewed by the viewing public through the transparent portion or entire area of the outer canister member 110. The canisters 108, 110, base 104, and writing indicia 1116 may be cylindrical or another shape desired by the user to carry out the purposes of the present invention. The indicia placement zone may be approximately 0.005-0.25 inches in width and may span substantially and continuously from the bottom end of the structure defining said zone to the upper end of the structure defining said zone.

The indicia placement zone 502 is beneficially sized and shaped to receive a conventional 8×11 piece of paper where text, pictures or other indicia can be conveniently and beneficially disposed or printed thereon by the user and displayed to the viewing public through the transparent outer canister member 110. In other embodiments, both the inner and outer canister members 108, 110 may be transparent. In other embodiments, the inner canister member 108 may be translucent or opaque (to provide better contrast against the indicia medium 116). When at least translucent, the canister members 108, 110 permit at least partial visibility of a fuel storage cavity 106. In one embodiment, the inner and outer shells may be of a thermally insulating material or lined with a thermally insulating material such as a cellulose-based plastic, polyurethane, fiberglass, mineral wool, or polyurethane foam.

Figure 7:
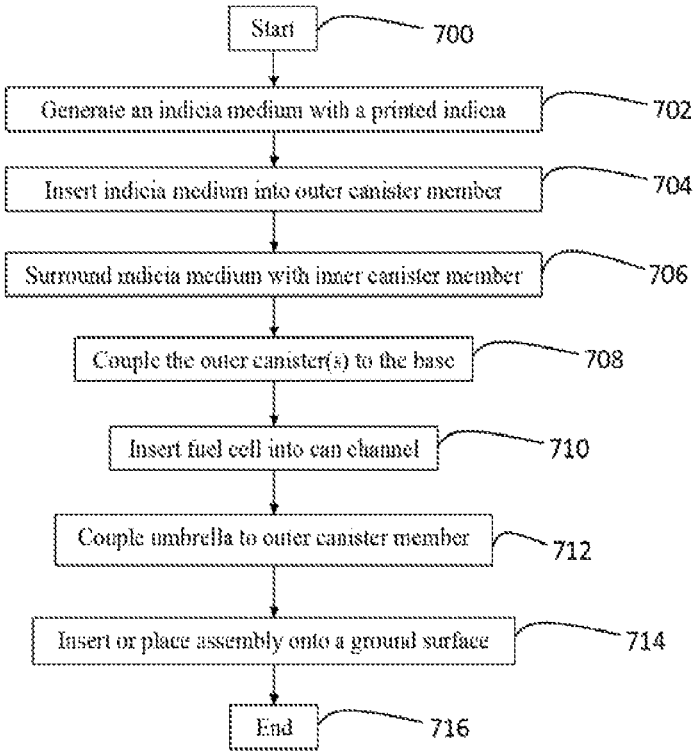
FIG. 7 is process-flow diagram depicting a method of displaying indicia through a fuel torch assembly in accordance with one exemplary embodiment of the present invention.

Referring specifically to FIG. 7, in connection with FIGS. 1-6, one exemplary method of use of the customizable fuel torch display assembly is depicted. Although FIG. 7 shows a specific order of executing the process steps, the order of executing the steps may be changed relative to the order shown in certain embodiments. Also, two or more blocks shown in succession may be executed concurrently or with partial concurrence in some embodiments. Certain steps may also be omitted in FIG. 7 for the sake of brevity. In some embodiments, some or all of the process steps included in FIG. 7 can be combined into a single process.

As such, the process starts at step 700 and immediately proceeds to step 702, which is to generate an indicia medium 116, which may be printed with an indicia 118 by a user and shaped into a cylinder by, for example, folding two lateral sides of the indicia medium together. Next, step 704 includes inserting the formed indicia medium into the outer canister member 110. In one embodiment, the indicia medium is inserted through the bottom end 130 of the outer canister member 110. In other embodiments, the medium 116 may be inserted through the upper end 136 of the outer canister member 110. Once inserted, the medium 116 may unfold slightly to provide a compression force against the inside surface of the outer canister member 110, thereby retaining the medium 116 within the outer canister member 110. In addition, or alternatively to the above, the medium 116 may be inserted through the lower end 130 until it reaches and is longitudinally retained by the upper wall 602 of the radial flange 600. Should only a portion of the outer canister member 110 include a transparent/translucent portion, the indicia 118 disposed on the medium 116 will be positioned adjacent to said portion. Preferably, however, a majority or all of the outer canister member 110 is transparent/translucent so positioning of the medium 116 is not required. \

Said differently, the writing indicia medium 116 may be wrapped around the inner canister 108, wherein the outer canister member 110 is inserted downwardly over the inner canister 108, wherein the indicia medium 116 is flanked by both the inner and outer canister members 108, 110. In further embodiments, the outer canister member 110 may define an upper aperture. When the outer canister member 110 is coupled to the base 104, the upper aperture provides access to the indicia placement zone 502 by the user. The upper aperture, which may continuously span around the inner canister member 108 to provide unfettered access to the indicia placement zone 502, may then be covered by the umbrella cover 112. In one embodiment of the present invention, the indicia placement zone 502 is watertight, in that water, liquid, or other environmental conditions are unable to access the indicia placement zone 502, thereby minimizing the risk of damaging or degrading the writing indicia 116 disposed therein.

Next, step 706 includes surrounding the indicia medium 116 with the inner canister member 108. This may be accomplished in variety of ways. In one exemplary method, the inner canister member 108 may be inserted into, coupled to, and/or retained by the base 104, with the outer canister member 110 then inserted into, coupled to, and/or retained by the base 104 and surrounding the inner canister member 108 and the indicia medium 116, thereby creating the indicia medium placement zone 502 described above. Alternatively, the user may insert the medium 116 into the outer canister member 110 and then insert the inner canister member 108 within the outer canister member 110 until it too reaches, is retained by, and/or is directly coupled to the flange 600. If the inner canister member 108 is integrally formed with the outer canister member 110, as described above, the indicia medium 116 will be surrounded by both canister members 108, 110 when inserted into the outer canister member 110. Further, when the indicia medium 116 is within the canister members 108, 110, it is also within the indicia medium placement zone 502.

Next, step 708 includes coupling the canister member(s) 108, 110 to the base 104, thereby placing the indicia placement zone in a watertight environment. After step 708, step 710 includes inserting a fuel or oil tank 106 or container may be inserted within the can channel 418 defined by the inner canister member 108. Next, the step 712 may include coupling the umbrella 112 to the outer canister member 110 to substantially encapsulate the can channel 418. Said another way, the top portion or end of the oil tank/wick 106 may then protrude outwardly from the wick aperture defined by the umbrella cover 112 when removably coupled to either the outer or inner canister members 108, 110. The snuffer/cap 114 may then by removably coupled to the umbrella cover to protect the wick for use by the user, i.e., lighting the wick and producing a reusable torch assembly 110. To change the writing indicia, e.g., depending on the desired use or event, the user may then inversely carry out the above steps.

The fuel storage cavity 418 provides a volume where a replaceable fuel tank 106 can be disposed therein. As seen in FIG. 4, the fuel tank 106 may be beneficially supported by a platform that places a top end of the fuel tank 106 and/or wick above the top end of the canister members 108, 110 and into the wick channel defined by the umbrella cavity (as those of skill in the art will appreciate). The fuel for the torch may also include added low concentrations of Citronella or Lemongrass oil to repel insects.

Step 714 includes placing the base 104 of the assembly on a ground surface and/or inserting the assembly, through the pole member 102, into the ground surface, thereby vertically displacing the assembly for elevational viewing by user while standing. As such, a customizable fuel torch display assembly has been disclosed that enables a user to safely, effectively, and efficiently customize and display indicia, such as messages, text, images, etc. to the viewing public. The process terminates at step 716.

What is claimed is:

1. A fuel torch display assembly comprising:

a base member having a bottom wall with an inside surface and a sidewall surrounding the bottom wall, the inside surface of the base member supporting a fuel canister with a distal end;

an inner canister member with an enclosed sidewall having a lower end coupled to the base member, an upper end, an inner surface, an outer surface opposing the inner surface, a can channel defined by the inner surface of the enclosed sidewall of the inner canister member, and a distal opening defined by the upper end of inner canister member, the can channel with the fuel canister disposed therein;

an outer canister member with an enclosed sidewall having an inner surface and of a transparent material defined on a portion thereon, a lower end, an upper end defining an upper opening and opposite the lower end of the enclosed sidewall, and an inner surface with a radial retention flange having:

an upper wall extending from a first end radially inward from the inner surface of the outer canister member toward the can channel and terminating at a second end opposite the first end; and a sidewall with a first end extending in a longitudinal direction from the second end of the upper wall of the radial retention flange toward the bottom wall of the base member and terminating at a second end opposite the first end of the sidewall of the radial retention flange, the upper wall and sidewall of the radial retention flange defining an inner canister member retention zone with the enclosed sidewall of the inner canister member disposed therein and the outer surface of the enclosed sidewall of the inner canister member and the inner surface of the enclosed sidewall of the outer canister member defining and flanking an indicia medium placement zone with an indicia medium selectively removably disposed therein and adjacent to the portion of the enclosed sidewall of the transparent material, thereby displaying an indicia disposed on the indicia medium to an outside ambient environment of the fuel torch assembly;

an umbrella cover removably coupled to the outer canister member and enclosing and defining an exit aperture with the distal end of the fuel canister disposed therein; and a cap removably coupled to the umbrella cover and superimposing the exit aperture.

2. The fuel torch display assembly according to claim 1, wherein:

the enclosed sidewall of the inner canister member, the enclosed sidewall of the outer canister member, and the indicia medium placement zone are cylindrical.

3. The fuel torch display assembly according to claim 1, wherein:

the indicia medium is of a printable paper material.

4. The fuel torch display assembly according to claim 1, wherein the radial retention flange further comprises:

an upper wall length separating the first and second ends of the upper wall of the radial retention flange; and a second sidewall with a first end extending in a longitudinal direction from a location along the upper wall length toward the bottom wall of the inside surface of the base member and terminating at a second end opposite the first end of the second sidewall of the radial retention flange, the upper wall, the sidewall, and the second sidewall of the radial retention flange defining the inner canister member retention zone.

5. The fuel torch display assembly according to claim 4, wherein:

the upper wall, sidewall, and second sidewall of the radial retention flange continually span an inside perimeter of the inner surface of the outer canister member.

6. The fuel torch display assembly according to claim 4, wherein the sidewall and second sidewall of the radial retention flange are disposed in a substantially parallel orientation with respect to one another.

7. The fuel torch display assembly according to claim 6, further comprising:

an inner canister thickness defined by inner and outer surfaces of the inner canister member; and a canister retention length separating inner surfaces of the sidewall and second sidewall of the radial retention flange, the canister retention length of approximately the same magnitude as the inner canister thickness.

8. The fuel torch display assembly according to claim 1, wherein:

the upper wall and sidewall of the radial retention flange continually span an inside perimeter of the inner surface of the outer canister member.

9. The fuel torch display assembly according to claim 1, further comprising:

upper and lower threaded configurations coupled and disposed proximal to the upper and lower ends, respectively, of the outer canister member, the upper threaded configuration interposed between the radial retention flange and the upper end of the outer canister member;

a threaded configuration coupled and disposed proximal to an upper end of the base member and operably configured to engage in a locking configuration with the lower threaded configuration of the outer canister member; and a threaded configuration coupled and disposed proximal to a lower end of the umbrella cover and operably configured to engage in a locking configuration with the upper threaded configuration of the outer canister member.

10. The fuel torch display assembly according to claim 1, further comprising:

a stabilization member coupled to and disposed on the inside surface of the base; and an inner canister stabilization member coupled to and disposed on a lower end of the inner canister member, the stabilization member of the base and the inner canister stabilization member of the inner canister member selectively removably coupled together in a male-female configuration restricting lateral movement of the inner canister member.

11. The fuel torch display assembly according to claim 10, wherein the base further comprises:

a bottom wall coupled to the enclosed sidewall of the inner canister member and having an inner surface and an outer surface, opposing the inner surface of the bottom wall of the inner canister, with the inner canister stabilization member coupled thereto;

a fuel canister displacement member coupled to and extending upwardly away from the inner surface of the bottom wall and terminating at a distal end directly coupled to and supporting the fuel canister.

12. A fuel torch display assembly comprising:

a base member including a sidewall coupled to a bottom wall with a pole member having a first end selectively removably couplable to the bottom wall and a free second end opposing the first end;

an inner canister member with an enclosed sidewall having a lower end coupled to the base member, an upper end, an inner surface, an outer surface opposing the inner surface, a can channel defined by the inner surface of the enclosed sidewall of the inner canister member, and a distal opening defined by the upper end of inner canister member;

an outer canister member with an enclosed sidewall having an inner surface and of a transparent material defined on a portion thereon, a lower end, an upper end defining an upper opening and opposite the lower end of the enclosed sidewall, and an inner surface with a radial retention flange having:

an upper wall extending from a first end radially inward from the inner surface of the outer canister toward the can channel and terminating at a second end opposite the first end; and a sidewall with a first end extending in a longitudinal direction from the second end of the upper wall of the radial retention flange toward the bottom wall of the inside surface of the base member and terminating at a second end opposite the first end of the sidewall of the radial retention flange, the upper wall and sidewall of the radial retention flange defining an inner canister member retention zone with the enclosed sidewall of the inner canister member disposed therein and the outer surface of the enclosed sidewall of the inner canister member and the inner surface of the enclosed sidewall of the outer canister member defining and flanking an indicia medium placement zone and adjacent to the portion of the enclosed sidewall of the transparent material;

an umbrella cover removably coupled to the outer canister member and enclosing and defining an exit aperture; and a cap removably coupled to the umbrella cover and superimposing the exit aperture.

13. The fuel torch assembly according to claim 12, wherein the bottom wall of the base member further comprises:

an inside surface supporting a fuel canister, the fuel canister disposed within the can channel.

14. The fuel torch assembly according to claim 12, wherein the inner canister member further comprises:

a bottom wall coupled to the enclosed sidewall of the inner canister member, the bottom wall having an inner surface and an outer surface, opposing the inner surface of the bottom wall of the inner canister, with an inner canister stabilization member coupled thereto.

15. The fuel torch display assembly according to claim 12, wherein the radial retention flange further comprises:

an upper wall length separating the first and second ends of the upper wall of the radial retention flange; and a second sidewall with a first end extending in a longitudinal direction from a location along the upper wall length toward the bottom wall of the inside surface of the base member and terminating at a second end opposite the first end of the second sidewall of the radial retention flange, the upper wall, the sidewall, and the second sidewall of the radial retention flange defining the inner canister member retention zone.

16. The fuel torch display assembly according to claim 15, wherein:

the upper wall, sidewall, and second sidewall of the radial retention flange continually span an inside perimeter of the inner surface of the outer canister member.

17. The fuel torch display assembly according to claim 16, wherein the sidewall and second sidewall of the radial retention flange are disposed in a substantially parallel orientation with respect to one another.

18. The fuel torch display assembly according to claim 17, further comprising:

upper and lower threaded configurations coupled and disposed proximal to the upper and lower ends, respectively, of the outer canister member, the upper threaded configuration interposed between the radial retention flange and the upper end of the outer canister member;

a threaded configuration coupled and disposed proximal to an upper end of the base member and operably configured to engage in a locking configuration with the lower threaded configuration of the outer canister member; and a threaded configuration coupled and disposed proximal to a lower end of the umbrella cover and operably configured to engage in a locking configuration with the upper threaded configuration of the outer canister member.

* * * * *